US005638853A

United States Patent [19]

Tsai

[11] Patent Number: 5,638,853

[45] Date of Patent: Jun. 17, 1997

[54] TENT STRUCTURE

[76] Inventor: Tony M. L. Tsai, Rm. 3, 4th Floor, No. 8, Fu Ching Street, Taipei City, Taiwan

[21] Appl. No.: 611,511

[22] Filed: Mar. 7, 1996

[51] Int. Cl.[6] ..... E04H 15/50

[52] U.S. Cl. ..... 135/145; 135/151; 135/155; 135/909

[58] Field of Search ..... 135/143, 144, 135/145, 146, 147, 153, 909, 155, 158, 159, 160, 140–142, 139, 131, 130, 135, 136

[56] References Cited

U.S. PATENT DOCUMENTS

| | | | |
|---|---|---|---|
| 3,826,270 | 7/1974 | Hentges | 135/153 X |
| 3,874,398 | 4/1975 | Hendrickson | 135/144 |
| 4,066,089 | 1/1978 | Rainwater | 135/143 X |
| 4,077,418 | 3/1978 | Cohen | 135/143 X |
| 4,365,908 | 12/1982 | Thiboutot | 135/143 X |
| 4,779,635 | 10/1988 | Lynch | 135/97 |
| 5,133,378 | 7/1992 | Tanasychuk | 135/153 X |
| 5,511,572 | 4/1996 | Carter | 135/145 |

FOREIGN PATENT DOCUMENTS

| | | | |
|---|---|---|---|
| 0691531 | 5/1953 | United Kingdom | 135/146 |

*Primary Examiner*—Lanna Mai

*Attorney, Agent, or Firm*—Morton J. Rosenberg; David I. Klein

[57] ABSTRACT

A tent structure includes four poles interconnected by four scissors-type linkages forming a square structure and four intermediate pivot connecting members. Each pole comprises a fixed connector and a sliding connector. Each of the fixed connector and the sliding connector has three connecting seats with two connecting seats at respective outer sides adapted to receive and end of the scissors-type linkage and with one connecting seat positioned inbetween the two outer seats adapted to receive an end of a rod member. Each intermediate pivot connecting member has a board and a pair of pivoting member integrally formed on top portion of the board and are adapted as an interconnecting member between the poles and a head connector. Each intermediate pivot connecting member confines the rod members to rotate upwardly only thus the tent is erected when the intermediate pivot connecting members are lifted to the upmost position and the tent is collapsed when the intermediate pivot connecting members are urged downwardly.

2 Claims, 12 Drawing Sheets

TENT STRUCTURE

BACKGROUND OF THE INVENTION

1. Field of the Invention

This invention relates to the structure of a tent, and more particularly to the structure which is easy to open and to close.

2. Background of the Prior Art Tent

Usually tents are categorized into two types, an open type and a closed type. The open type tent, as shown in FIGS. 16 and 17, is like a canopy roof which is constructed by a cloth D being supported by four poles A, four scissors-type linkages B and a center strut C. Each pole A has a fixed hinge A1 at the top end, and a sliding hinge A2 therealong. The center strut C includes a sliding cross-shaped connector E and a fixed cross-shaped connector F. Each connectors E and F are hingedly connected to one end of a scissors-type linkage B. The other end of the scissors-type linkages B are hinged to the fixed hinge A1 and the sliding hinge A2, respectively. When pulling the four poles A outwardly, the sliding hinges A2 will slide along the pole A to the upmost position while the sliding cross-shaped connector E will slide along the strut C to the lowermost: position and the tent is formed, as shown in FIG. 17. This structure relies entirely upon the four scissors-type linkages B forming the cross connection that is easy to become destruction.

SUMMARY OF THE INVENTION

It is the primary object of the present invention to provide a tent structure which is solid and strong.

It is another object of the present invention to provide a tent structure which makes the opening and closing the tent easily.

It is a further object of the present invention to provide a tent structure which service life is longer.

DETAILED DESCRIPTION OF THE PREFERRED EMBODIMENT

Figure 1:
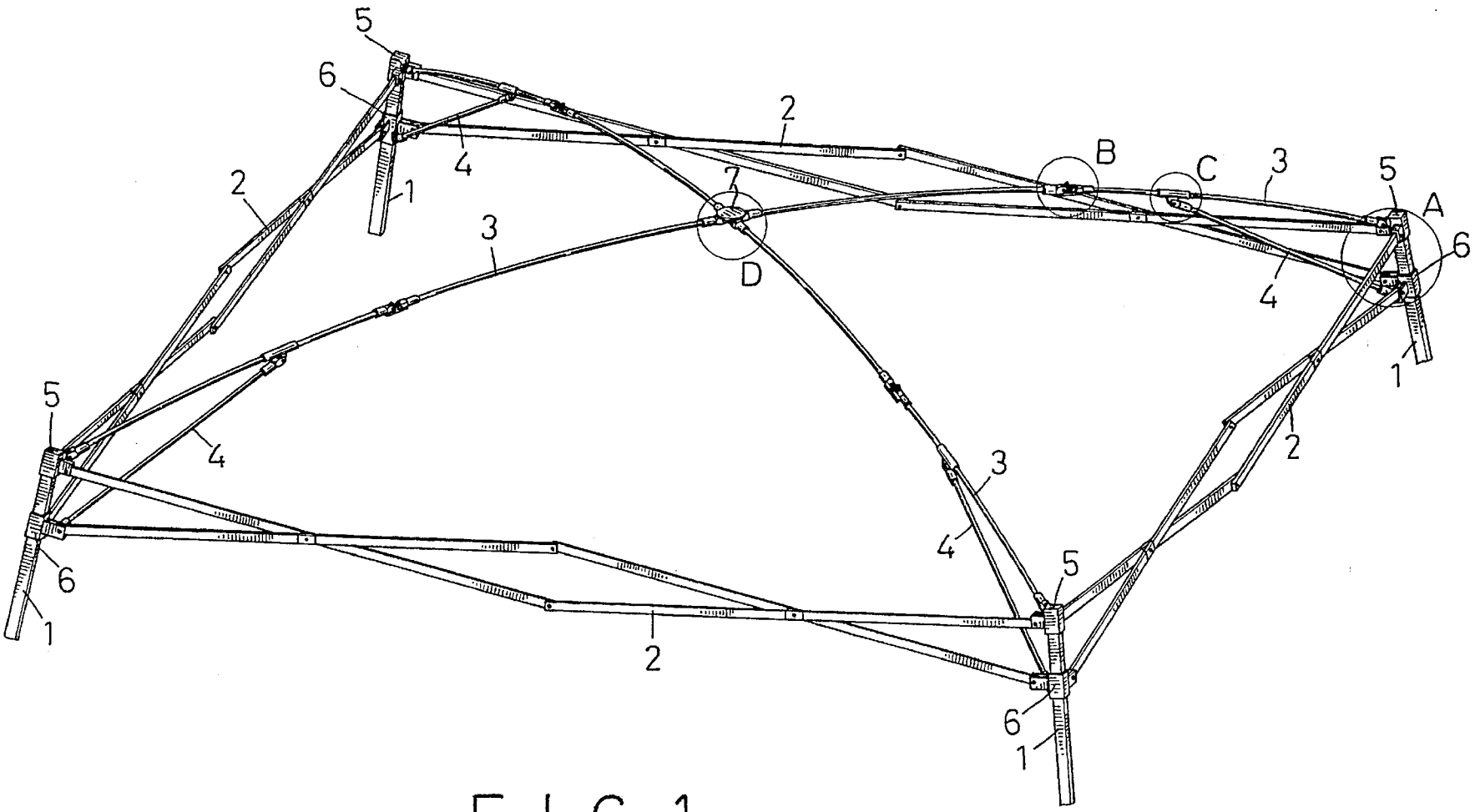
FIG. 1 is a perspective view of the present invention in use.
Figure 2:
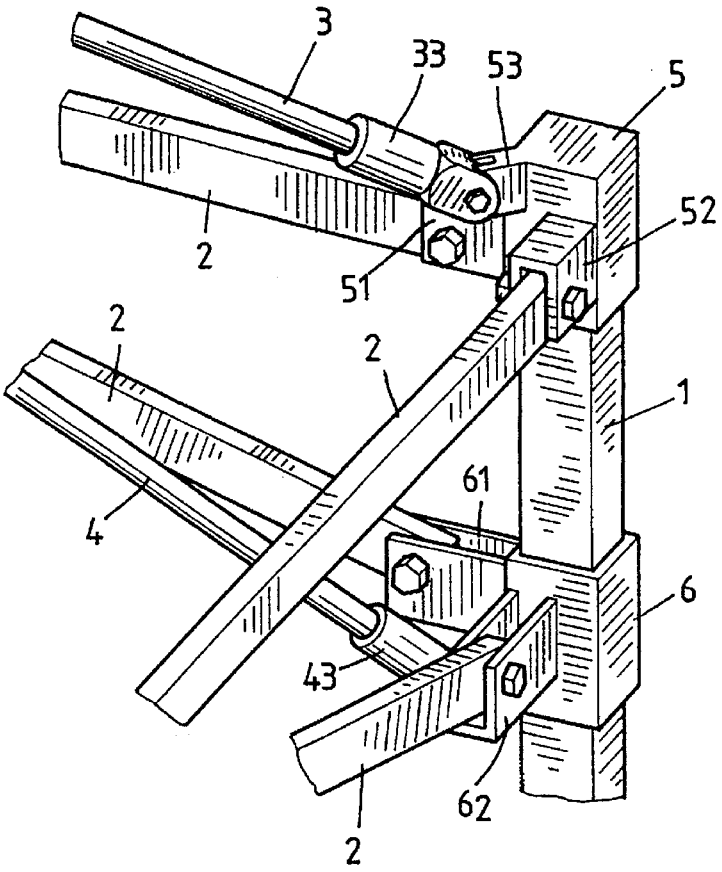
FIG. 2 is an enlarged view of circle A shown in FIG. 1.
Figure 3:
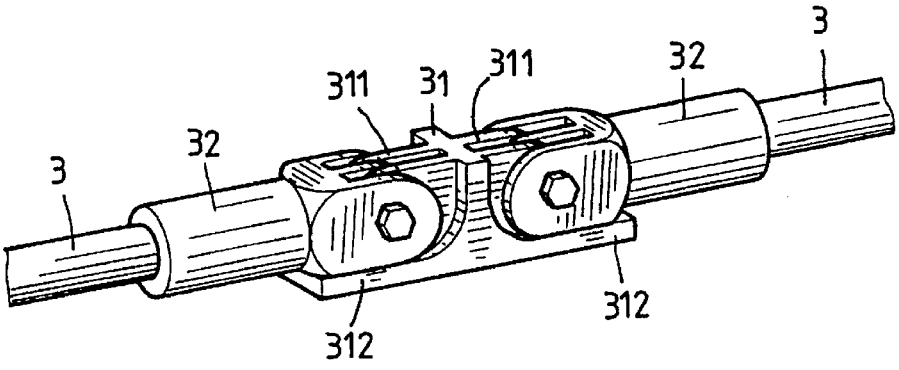
FIG. 3 is an enlarged view of circle B shown in FIG. 1.
Figure 4:
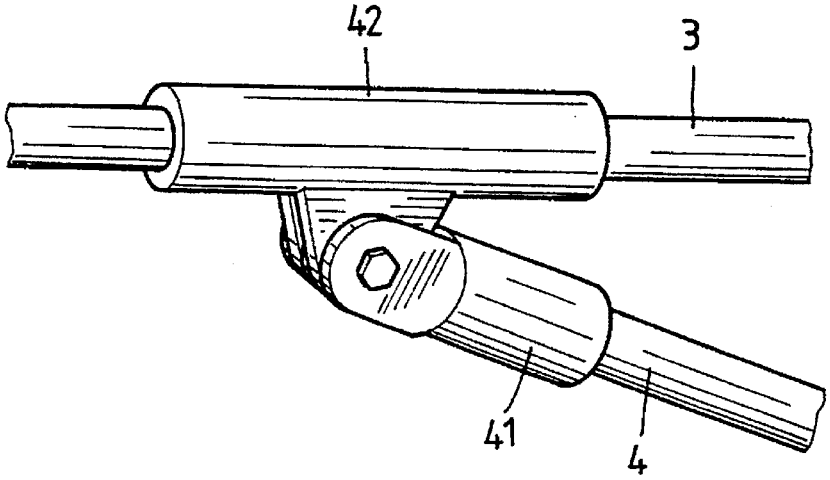
FIG. 4 is another enlarged view of circle c shown in FIG. 1.
Figure 5:
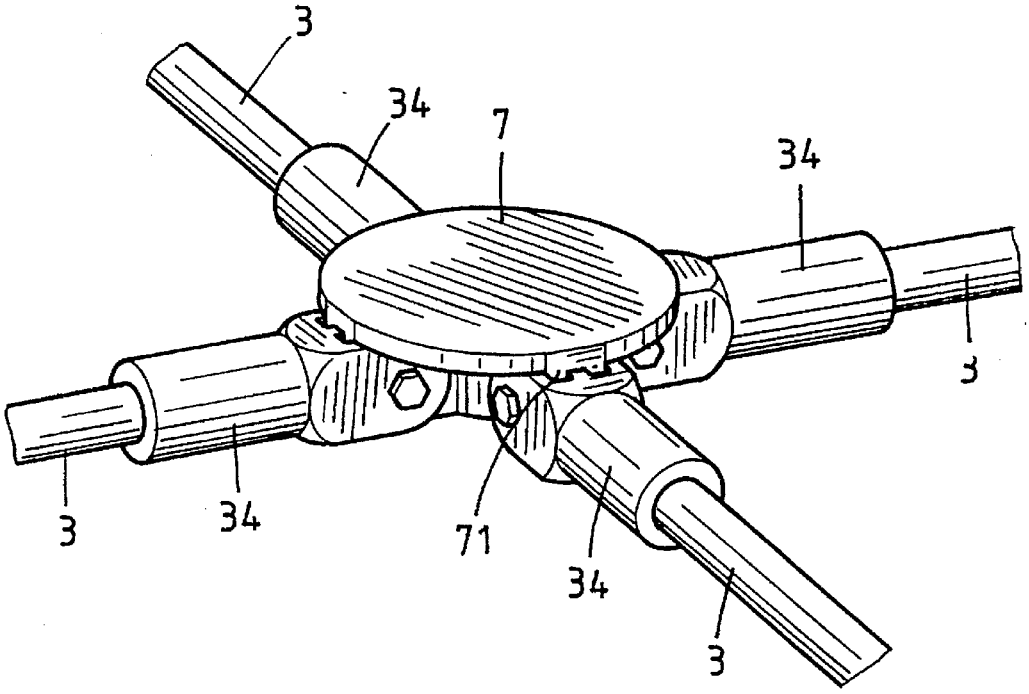
FIG. 5 is still a further enlarged view of circle D shown in FIG. 1.

Referring to the drawings in particular to FIGS. 1 through 5, the structure of the present invention is composed of four vertical poles 1, four scissors-type linkages 2, four sets of rods 3, four linking rods 4, four fixed connectors 5 secured on the top end of each pole 1 and four sliding connectors 6 slidably along each ploe 1, respectively.

Figure 6:
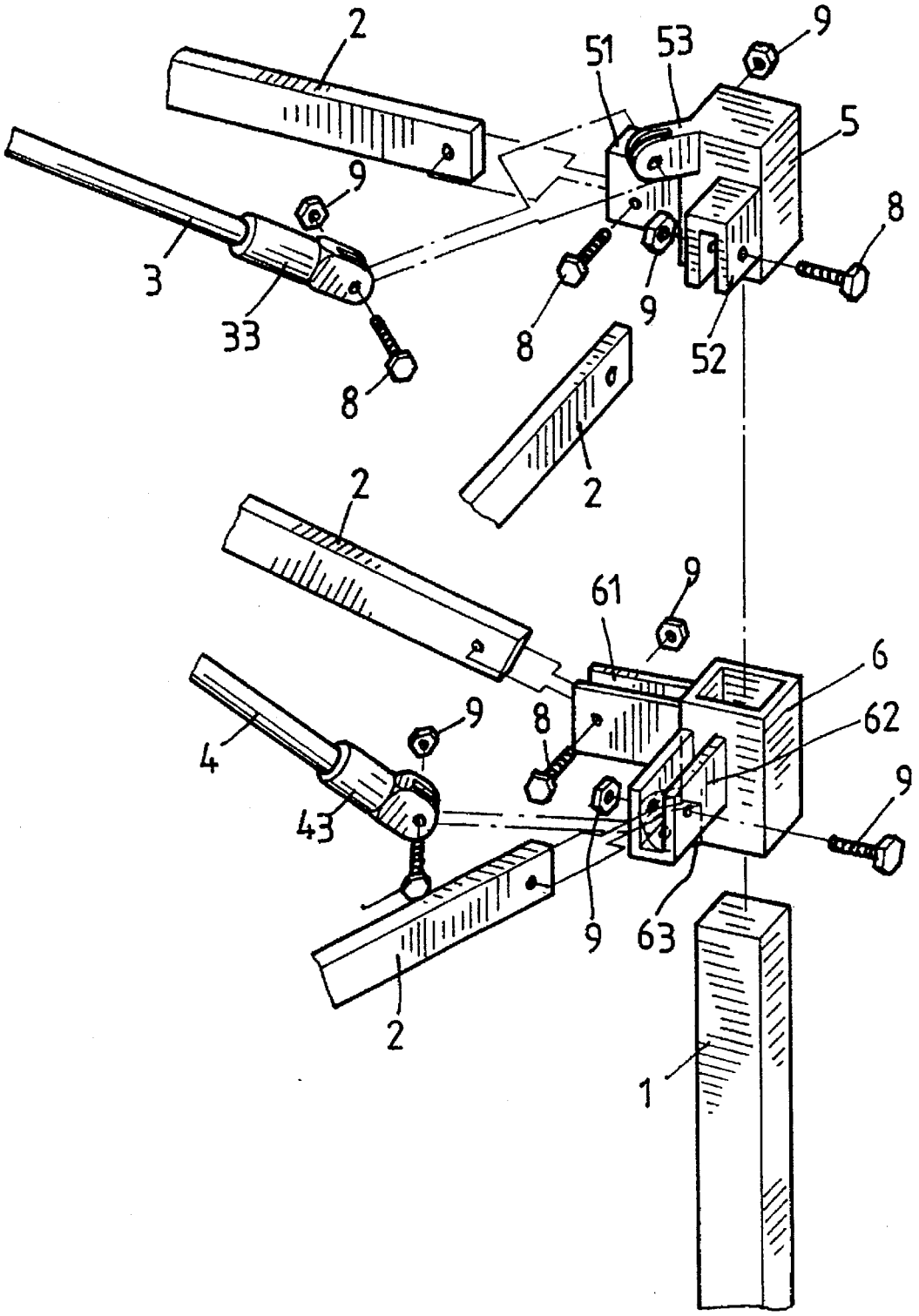
FIG. 6 is an exploded view of FIG. 2.

Each pole 1 has a fixed connector 5 at top end and a sliding connector 6 under the fixed connector 5, as shown in FIG. 6. Each of the connectors 5 and 6 includes three connecting seats 51, 52, 53, 61, 62 and 63 extending outwardly and respectively. The connecting seats 51, 52 and 61, 62 are formed at outer ends thereof adapted to secure one end of each scissors-type linkage 2 by means of bolts 8 and nuts 9 to connect the poles 1 together. The other seats 53 and 63 are formed at center portion inbetween the seats 51, 52 and 61, 62 respectively adapted to secure the retractable rods 3 and linkage rods 4, respectively.

Figure 7:
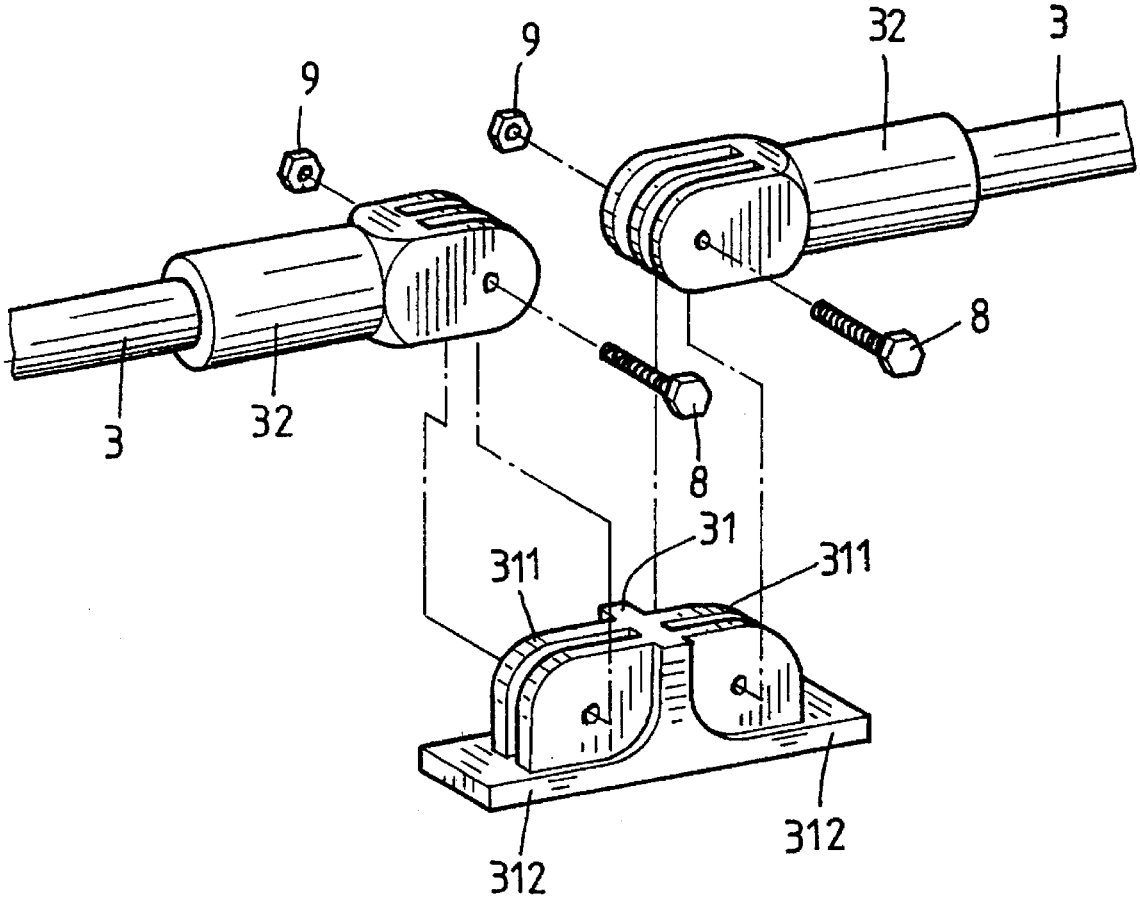
FIG. 7 is an exploded view of FIG. 3.

Each rod set 3 is formed by two rod members pivotally connected to an intermediate pivot connecting member 31, as shown in FIG. 7. The intermediate pivot connecting member 31 includes a pair of pivoting members 311 integrally formed on top of a board 312 adapted to secure an rod end 32 thereat which allow the rod members 3 to pivot upwardly only. The other end of the rod members are formed with another connectors 33 and 34 and are swingly connected to the center connecting seat 53 of the fixed connector 5 and to a head connector 7, respectively, as shown in FIG. 9.

Figure 8:
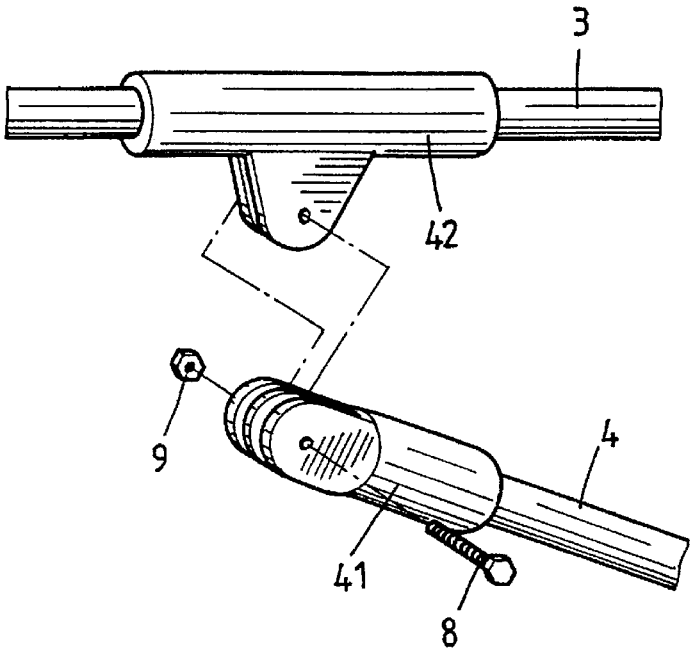
FIG. 8 is an exploded view of FIG. 4.

Each linkage 4 includes two end connectors 41 and 43 which are connected to a connecting member 42 slidably sleeved on the rod member 3 and to the center connecting seat 63 of the sliding connector 6, respectively, as shown in FIG. 8.

Figure 9:
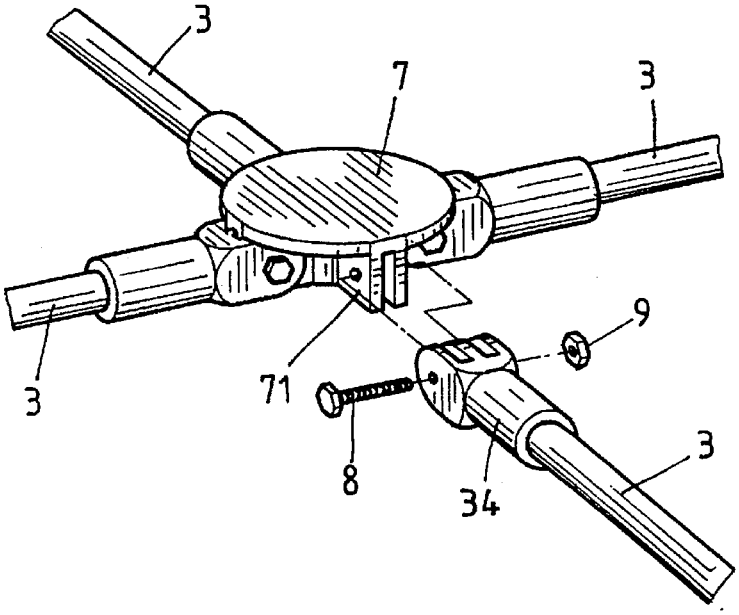
FIG. 9 is a partially exploded view of FIG. 5.
Figure 10:
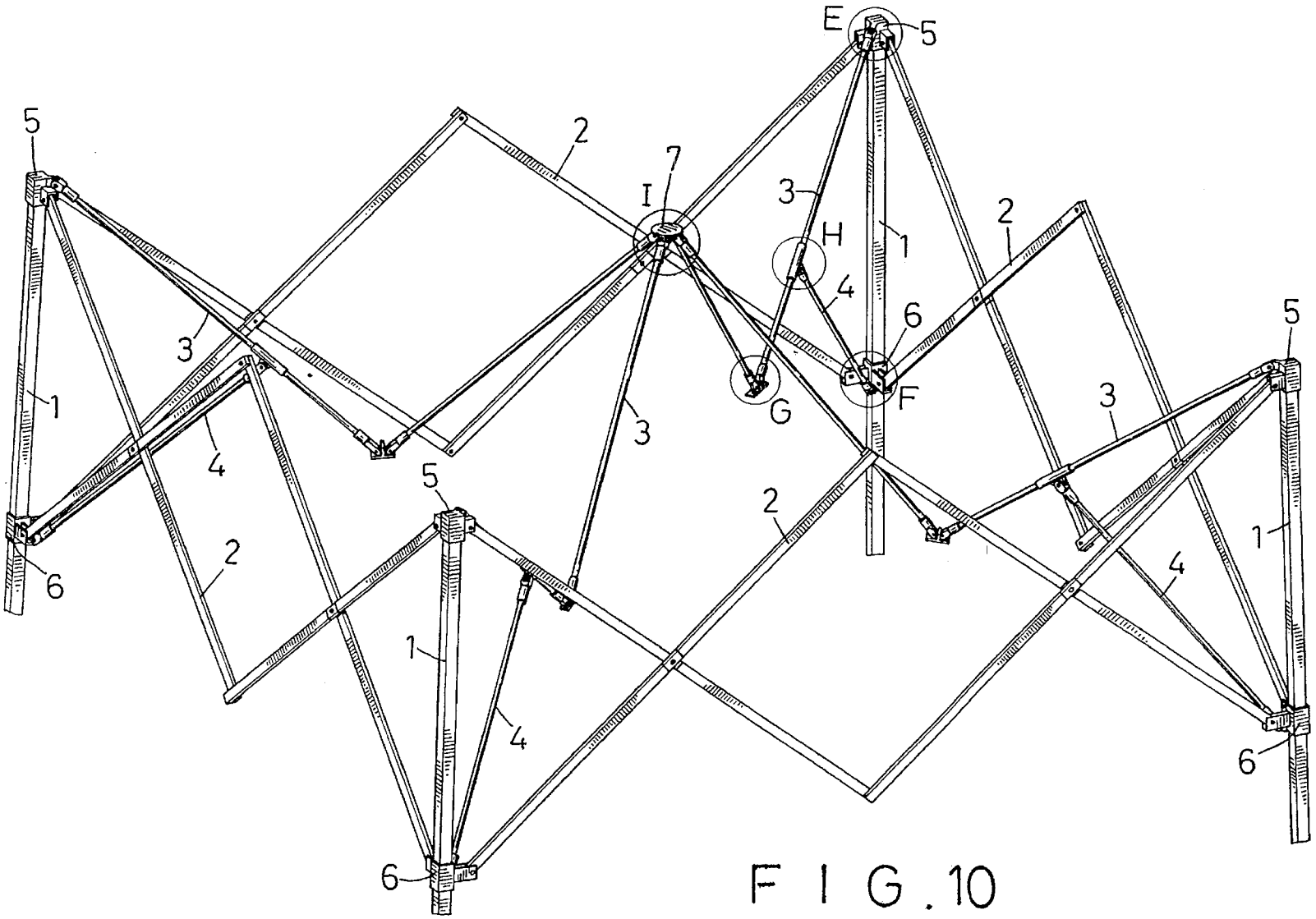
FIG. 10 is an illustrated view showing a collapsed view of the present tent structure.
Figure 11:
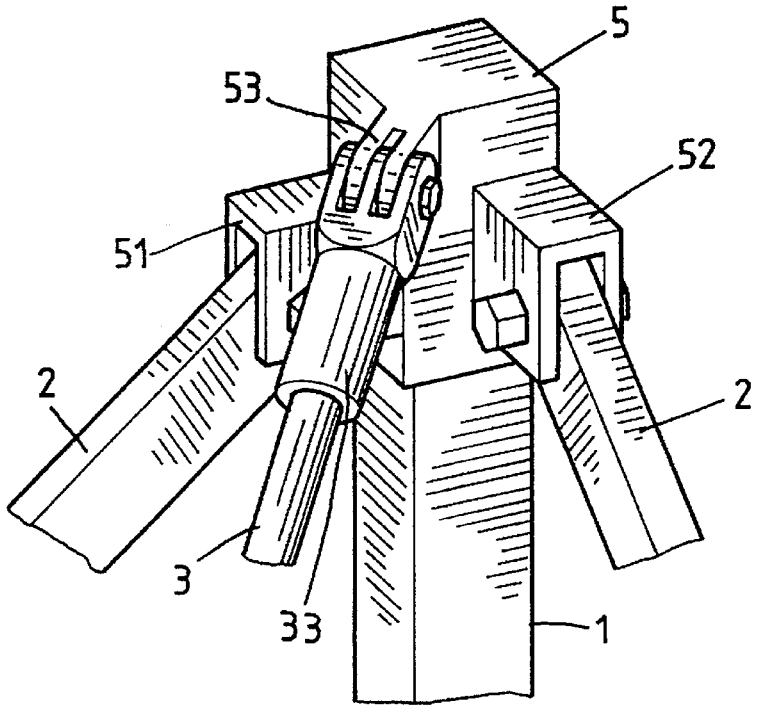
FIG. 11 is an enlarged view of circle E shown in FIG. 10.
Figure 12:
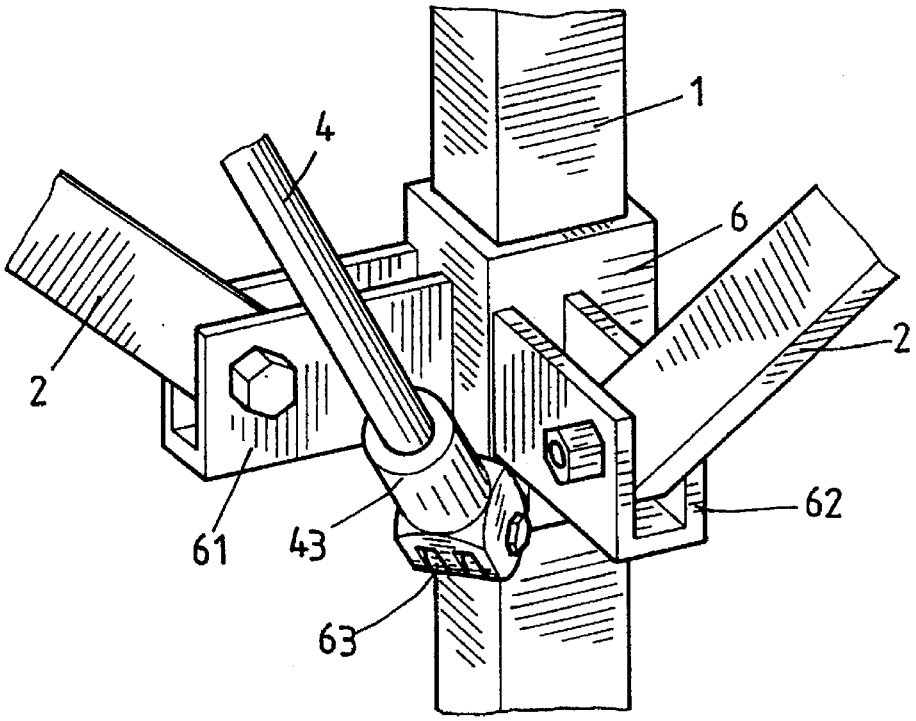
FIG. 12 is an enlarged view of circle F shown in FIG. 10.
Figure 13:
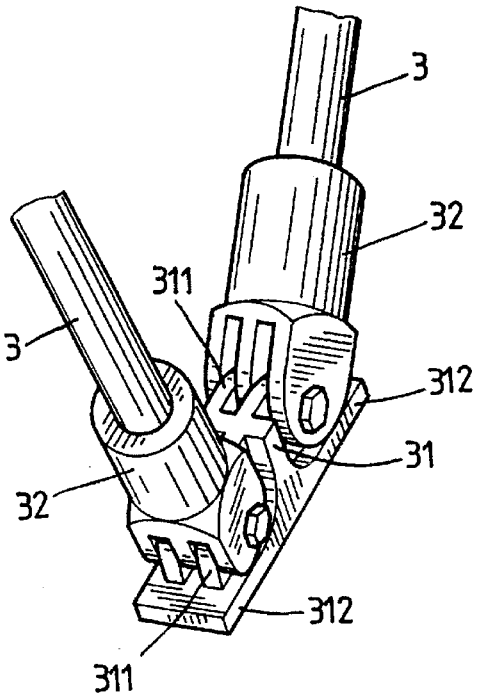
FIG. 13 is another enlarged view of circle G shown in FIG. 10.
Figure 14:
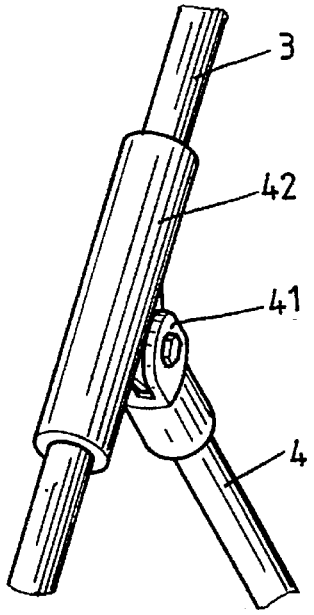
FIG. 14 is still another enlarged view of circle H shown in FIG. 10.
Figure 15:
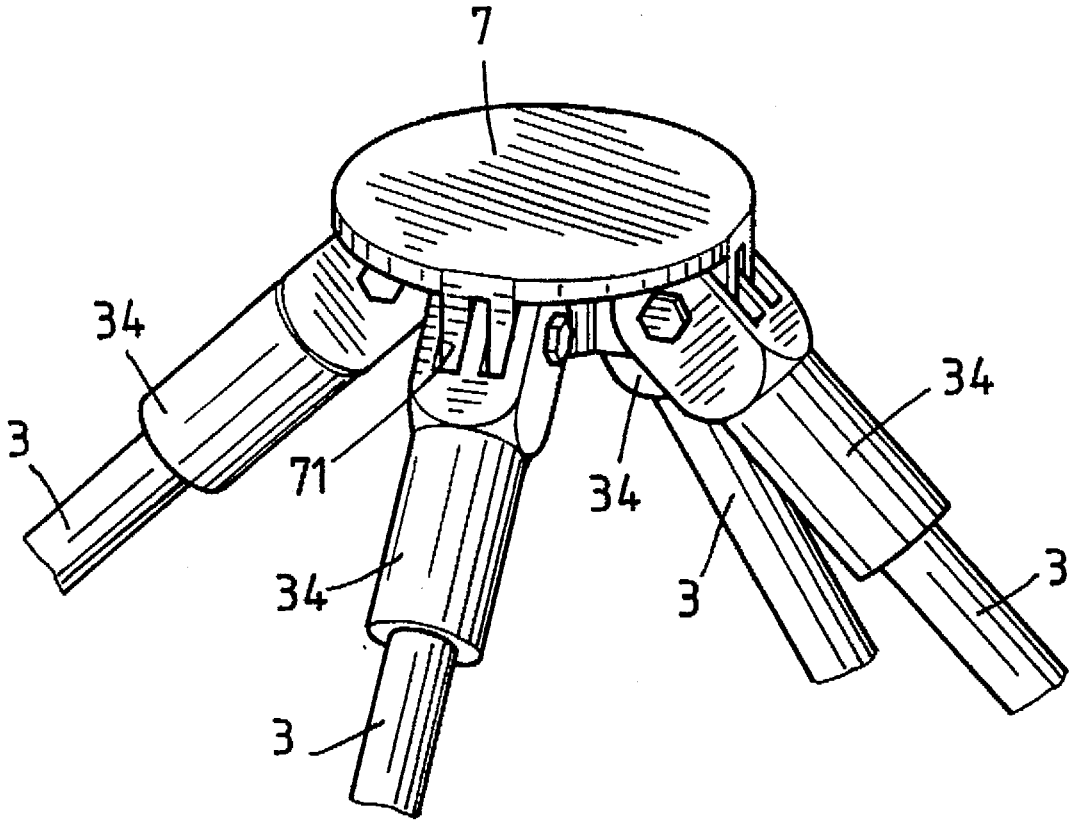
FIG. 15 is a further enlarged view of circle I shown in FIG. 10.
Figure 16:
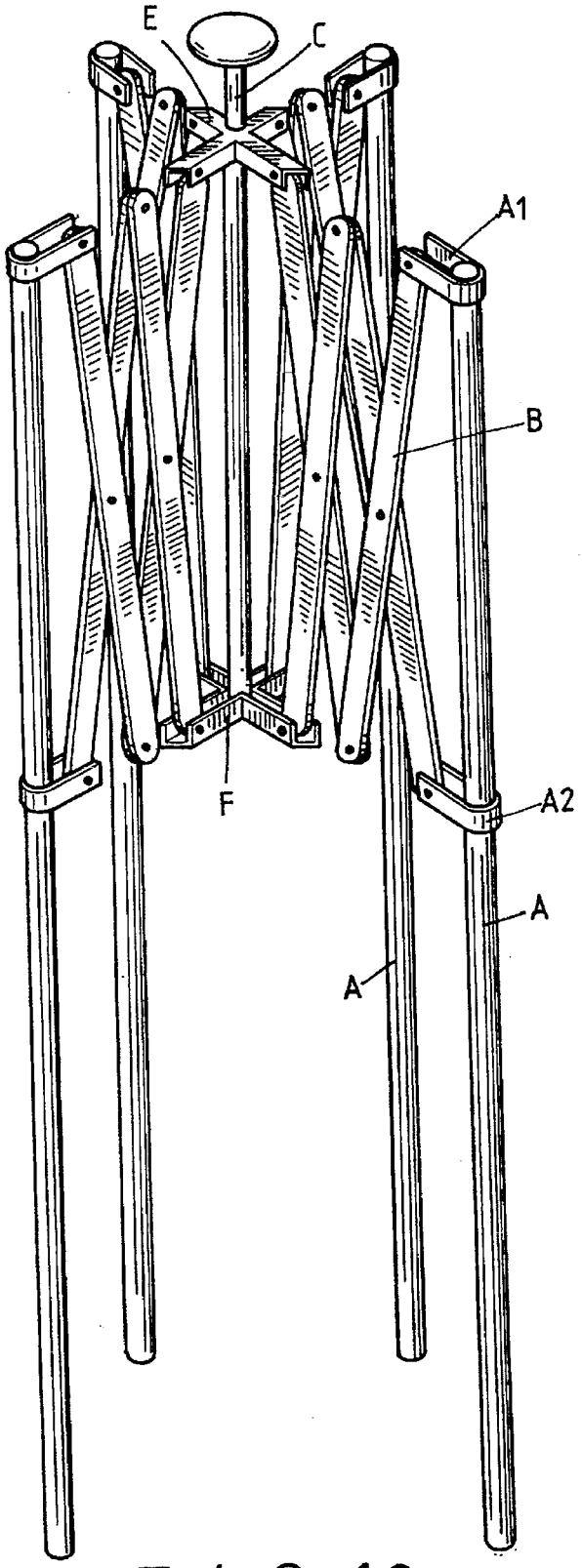
FIG. 16 (PRIOR ART)
FIGS. 16 and 17 are prior art tent structure.
Figure 17:
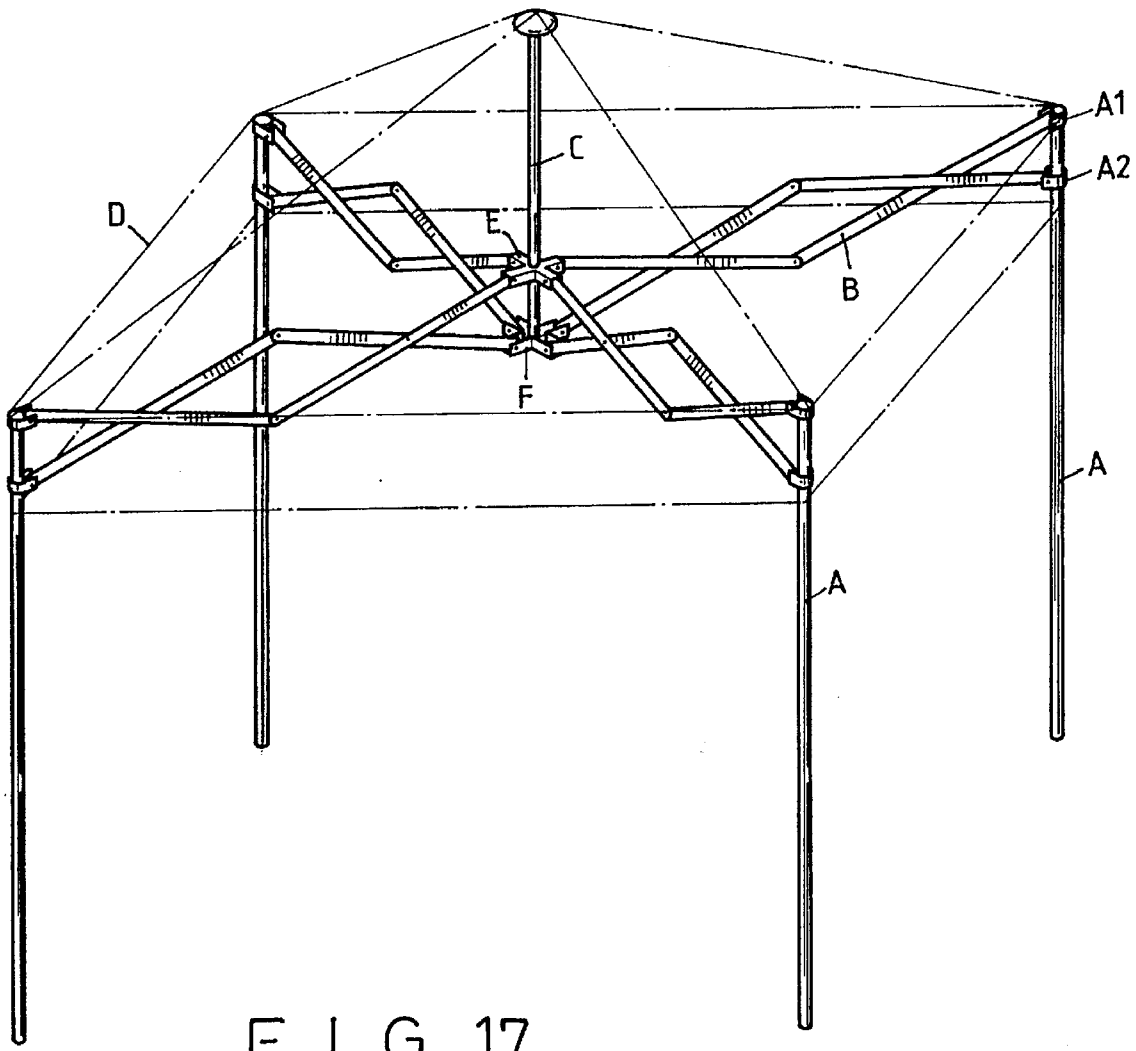
FIG. 17 (PRIOR ART)

The head connector 7, as shown in FIG. 9, includes four pair of walls extending from one end and equally spaced from each other. Each pair of walls defining a recess 71 therein adapted to secure rod connector 34.

In operation, the tent of the present invention very easy to assembled, erected and folded. When erecting, manually pull the four poles 1 outwardly which urge the four intermediate pivot members 31 to move upwardly which rotate the rod members 3 to rotate upwardly and the sliding connector 6 on each pole 1 to slide upwardly along the pole 1. Upon the intermediate pivot members 31 have reached to the upmost, the tent is maintained in a stable configuration with the four poles 1 spread by the scissors-type linkages 2 and the head connector 7 is spread by the rod members 3 and the linkage rod members 4 in a sturdy position. There is no need to disassemble any parts to collapse the tent. In collapsing the tent, all scissors-type linkages 2 are urged downwardly and all intermediate pivoting members 31 are manually rotated which causes the rod members 3 to pivot toward each other until each pair of rod members are gathered together, such result, the structure is a compact unit, as shown in FIGS. 10–15.

I claim:

1. A tent structure, comprising:

four vertically directed poles;

four fixed connectors respectively coupled to said four vertically directed poles, each of said fixed connectors being secured to an upper end of a respective one of said vertically directed poles, each of said fixed connectors having a pair of radially spaced first outer connecting seats formed thereon and a first center connecting seat disposed between said pair of first outer connecting seats;

four sliding connectors respectively coupled to said four vertically directed poles, each of said sliding connectors being slidingly coupled to a respective one of said vertically directed poles, each of said sliding connectors having a pair of radially spaced second outer connecting seats formed thereon and a second center connecting seat disposed between said pair of second outer connecting seats;

four scissors-type linkages respectively coupling each of said four vertically directed poles to an adjacent pair thereof, each of said scissors-type linkages being pivotally coupled on opposing ends thereof to a respective one of said first and second outer connecting seats;

four rods respectively coupled to said four vertically directed poles, each of said rods having opposing first and second ends, said first end of each said rod being pivotally coupled to a respective one of said first center connecting seats, each of said rods including a first rod member and a second rod member pivotally connected together intermediate said first and second ends of said rod;

a head connector pivotally coupled to said second end of each of said four rods; and, four linking rods respectively coupled between said four rods and said four vertically directed poles, each of said linking rods being pivotally coupled on a first end to said second center connecting seat of a respective one of said sliding connectors and slidingly coupled to a respective one of said rods where each of said rods includes an intermediate pivot connecting member for pivotally coupling said first rod member to said second rod member, said intermediate pivot connecting member including a pair of opposing pivot members spaced above board member, said board member limiting a pivotal displacement direction of said first and second rod members.

2. The tent structure as recited in claim 1 where said head connector includes four radially spaced recesses for receiving said second ends of said four rods therein, each of said recesses being defined between a pair of spaced integrally formed wall members.

* * * * *